United States Patent [19]

Weisshuhn et al.

[11] Patent Number: 4,897,158

[45] **Date of Patent: * Jan. 30, 1990**

[54] HEADBOX APPARATUS FOR A PAPERMAKING MACHINE

[75] Inventors: Elmer Weisshuhn, Vogt; Alfred Bubik, Ravensburg; Hans Dahl, Ravensburg; Herbert Holik, Ravensburg; Rüdiger Kurtz, Immenstaad; Anton Zembrot, Aulendorf; Wolf-Gunter Stotz; Werner Seider, both of Ravensburg; Robert Tröndle, Ravensburg, all of Fed. Rep. of Germany

[73] Assignee: Sulzer-Escher Wyss GmbH, Ravensburg, Fed. Rep. of Germany

[ * ] Notice: The portion of the term of this patent subsequent to Feb. 6, 2007 has been disclaimed.

[21] Appl. No.: 272,340

[22] Filed: Nov. 17, 1988

Related U.S. Application Data

[63] Continuation of Ser. No. 873,196, May 19, 1986, which is a continuation of PCT EP85/00473 filed Sep. 16, 1985.

[30] Foreign Application Priority Data

Sep. 19, 1984 [CH] Switzerland ..... 04489/84
Feb. 28, 1985 [CH] Switzerland ..... 00915/85

[51] Int. Cl.[4] ..... D21F 1/06

[52] U.S. Cl. ..... 162/259; 162/336; 162/343; 162/344; 162/347

[58] Field of Search ..... 162/216, 259, 336, 337, 162/338, 343, 344, 347

[56] References Cited

U.S. PATENT DOCUMENTS

| | | | |
|---|---|---|---|
| 2,904,461 | 9/1959 | Washburn et al. | 162/216 |
| 3,434,923 | 5/1969 | Dennis | 162/337 |
| 3,547,775 | 12/1970 | Bossen et al. | 162/198 |
| 3,556,935 | 1/1971 | Amneus et al. | 162/214 |
| 3,573,160 | 3/1971 | Lopas | 162/259 |
| 4,137,124 | 1/1977 | Bubik et al. | 162/344 |
| 4,285,767 | 8/1981 | Page | 162/216 |
| 4,374,703 | 2/1983 | Lebeau et al. | 162/259 |
| 4,414,062 | 11/1983 | Kirjavairen | 162/336 |

FOREIGN PATENT DOCUMENTS

| | | |
|---|---|---|
| 363776 | 8/1981 | Austria . |
| 2151906 | 4/1973 | Fed. Rep. of Germany . |
| 1216114 | 5/1969 | United Kingdom . |

*Primary Examiner*—Karen M. Hastings
*Attorney, Agent, or Firm*—Werner W. Kleeman

[57] ABSTRACT

In a headbox system for a papermaking machine with an adjustable distribution of the fiber stock suspension or pulp over the web width, the flow in the delivery slice is controlled in such a way that, across the web width, also the distribution of the fibers in respect of fiber orientation and quantity has a desired profile. For this purpose, the flow of the fiber stock suspension is controlled such that in the event of a change in the distribution of the fiber stock suspension across the web width, the horizontal component of the flow direction in the delivery slice remains, at all locations, always in the predetermined machine direction and thus transverse flows are avoided and the flow rate in the delivery slice has a predeterminate profile.

37 Claims, 4 Drawing Sheets

HEADBOX APPARATUS FOR A PAPERMAKING MACHINE

CROSS-REFERENCE TO RELATED APPLICATIONS

This application is a continuation application of the commonly assigned co-pending U.S. application Ser. No. 06/873,196, filed May 19, 1986, entitled "HEADBOX APPARATUS FOR A PAPERMAKING MACHINE AND METHOD OF OPERATING THE SAME", which, in turn, is a continuation of International PCT application Ser. No. PCT/EP85/00473, filed Sept. 16, 1985. The present application is also related to the commonly assigned co-pending U.S. application Ser. No. 07/206,496, filed June 13, 1988, which is a divisional application of the aforementioned parent application Ser. No. 06/873,196.

BACKGROUND OF THE INVENTION

The present invention broadly relates to a new and improved construction of a headbox apparatus for a papermaking machine.

In its more particular aspects, the present invention specifically relates to a new and improved construction of a headbox apparatus for a papermaking machine which defines a predetermined machine direction and a predetermined web width and which produces a paper web from an infed fiber stock suspension flowing through such headbox apparatus. The headbox apparatus contains a distribution box or distributor for distributing an infed fiber stock suspension or pulp across the web width of the papermaking machine. A diffusor or guide system follows the distribution box or distributor and possesses a plurality of diffusor bores or channels for the infed fiber stock suspension and a subsequent nozzle chamber contains a delivery gap for distributing the infed fiber stock suspension at a predetermined weight per unit area across the web width defined by the papermaking machine. The weight per unit area or mass distribution across the web width of the papermaking machine is selectively variable by locally changing the opening width of the delivery slice or gap and/or by locally varying the stock density of the infed fiber stock suspension. The invention also relates to a method of operating such headbox apparatus.

Headbox apparatuses of such type are known, for example, from U.S. Pat. No. 4,087,321, granted May 2, 1978. They serve for infeeding a prepared fiber stock suspension into a papermaking machine and for distributing the infed fiber stock suspension in a predetermined manner across the entire web width of the papermaking machine. This distribution of the infed fiber stock suspension should be carried out such that the paper web produced by the papermaking machine has preselected parameters or characteristics across the web width. In most cases there is thus intended a uniform weight per unit area or mass per unit area after drying, a uniform dampness, as well as a uniform fiber orientation across the whole web width.

From U.S. Pat. Nos. 3,556,935, granted Jan. 19, 1971, and 4,089,739, granted May 16, 1978, it is known in this respect to construct the opening width of the delivery slice or gap of the nozzle chamber in an adjustable manner by using a number of adjusting devices distributed across the web width. There can be controlled thereby the quantity of the infed fiber stock suspension passed across the web width but not the fiber orientation.

Inadequacies based on the construction of the papermaking machine, as well as physical phenomena which occur during the papermaking process, are the reason that in most cases not all parameter values or characteristics across the web width occur simultaneously as desired or in a uniform manner. For example, deficiencies in the sieve part or shrinking of the paper web during drying, especially at the edge of the web, are compensated for by variation of the local stock mass flow just as inadequacies in the geometry of the distribution box or distributor, the diffusion or guide system or the nozzle chamber. For varying or adjusting the local stock mass flow, there is locally varied in many cases the opening width of the slice or outlet gap from the nozzle chamber.

However, the pressure in the nozzle chamber is thereby also locally varied and the pressure variation in the infed fiber stock suspension is non-uniform across the web width of the papermaking machine. These local pressure differences in the nozzle chamber result in transverse flows in the nozzle chamber and such transverse flows become effective up to the delivery slice or gap, particularly in a manner such that the direction of the flow in the nozzle chamber, as viewed across the web width, is not exactly parallel and does not conform with the direction of the papermaking machine. Even small deviations from the direction of the papermaking machine lead to undesired non-uniformities in respect of the fiber orientation in the produced paper web across the web width due to the transverse components of the velocity vector present during the outflow of the jet of the fiber stock suspension.

It is already known from Austrian Patent No. 363,776, granted Aug. 25, 1981, to balance pressure differences in the flow of infed fiber stock suspension in the distribution box or distributor across the web width by additionally infeeding or withdrawing fiber stock suspension into or from the infed fiber stock suspension at suitable locations, for example, in the distribution box or distributor so that the pressure variation in the distribution box or distributor is constant across the entire web width. However, solely using these measures, not all pressure differences in the nozzle chamber can be balanced.

It is known from U.S. Pat. No. 3,573,160, granted Mar. 30, 1971, to measure the velocity profile of the infed fiber stock suspension across the web width and to appropriately adjust the cross-section of the distribution box or distributor, e.g. by means of a displaceable wall, in order to achieve a uniform fiber stock suspension velocity in the delivery slice or gap. Pressure differences and transverse flows also can only be incompletely prevented by such adjustment.

As described in British Patent No. 1,216,114, it has already also been attempted to achieve a uniform flow of the infed fiber stock suspension by providing a number of individually adjustable overflow pipes at the distribution box or distributor. The aforementioned disadvantages also cannot be avoided thereby.

For example, additional pressure drops or losses occur in the nozzle chamber at its margins due to friction losses at the side walls. Such additional pressure drops or losses cause the pressure in the nozzle chamber and the throughput stock mass flow to decrease toward the aforementioned margins. As a result, transverse flows are also generated thereby in the nozzle chamber and result in flow lines which are no longer aligned exactly parallel to the predetermined direction of the papermaking machine.

It is proposed in German Patent Publication No. 2,151,906, published Apr. 26, 1973, that, for achieving uniform velocity and stock mass flow of the fiber stock suspension also in the marginal regions, there be provided at the distribution box or distributor a gap which is individually adjustable across the web width. Pressure differences and transverse flows in the delivery slice or gap, however, are also present in this construction.

Also in the case of a number of mutually offset rows of diffusor bores or channels in the diffusion or guide system as disclosed, e.g. in U.S. Pat. No. 4,137,124, granted Jan. 30, 1977, there are present in the marginal regions, non-uniformities such as smaller stock mass flows per unit width and such non-uniformities also lead to pressure differences and to transverse flows in the nozzle chamber and at the slice or gap. By infeeding additional fiber stock suspension or water at the sides through the side walls of the nozzle chamber, this could possibly be compensated for but is contingent upon a considerable complication in terms of machinery and control techniques.

SUMMARY OF THE INVENTION

Therefore, with the foregoing in mind, it is a primary object of the present invention to provide a new and improved construction of a headbox apparatus for a papermaking machine as well as a method of operating such headbox apparatus and which apparatus and method do not exhibit the aforementioned drawbacks and shortcomings of the prior art.

Another and more specific object of the present invention aims at providing a new and improved construction of a headbox apparatus for a papermaking machine as well as a method of operating such headbox apparatus and which apparatus and method permit setting-up, in the nozzle chamber and the delivery slice or gap, a flow condition substantially free of transverse flows even in the presence of variations in the local stock mass flows and which variations are required for adjusting desired transverse profiles of the weight per unit area values.

A further significant object of the present invention is directed to a new and improved construction of a headbox apparatus for a papermaking machine as well as a method of operating such headbox apparatus and which apparatus and method result in the production of a paper web in which the fibers are substantially uniformly oriented across the web width.

Yet a further significant object of the present invention aims at providing a new and improved construction of a headbox apparatus for a papermaking machine of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the headbox apparatus of the present development, among other things, is manifested by the features that, substantially simultaneously with a change in the weight per unit area or mass distribution across the predetermined web width, the flow of the infed fiber stock suspension in the nozzle chamber is simultaneously adjustable such that, as viewed across the predetermined web width of the papermaking machine, the horizontal components of the flow direction of the infed fiber stock suspension at the delivery slice or gap extend substantially parallel to the predetermined machine direction and the flow velocity at the delivery slice or gap corresponds to a predetermined profile as viewed across the predetermined web width of the papermaking machine.

This may, for example, be selectively carried out by varying the pressure profile in the distribution box or distributor, by varying the geometrical dimensions of the distribution box or distributor, the diffusor or guide system or the nozzle chamber, or by infeeding fiber stock suspension or water into the distribution box or distributor, the diffusor or guide system or the nozzle chamber, or by withdrawing infed fiber stock suspension from the distribution box or distributor, the diffusor or guide system or the nozzle chamber, either individually or in combination with each other.

It is achieved through such variation that the flow in the delivery slice or gap is affected such that notwithstanding an adjustment of the weight per unit area or mass distribution to a desired transverse profile, no transverse flows arise. There is thus obtained a paper having the desired weight per unit area or mass distribution and the desired, e.g. uniform fiber distribution with regard to mass and orientation across the width of the web.

As alluded to above, the invention is not only concerned with the aforementioned headbox apparatus construction aspects but also relates to an inventive method of operating such headbox apparatus for a papermaking machine. To achieve the aforementioned measures, the inventive method, in its more specific aspects, comprises, when varying the weight per unit area or mass distribution of the infed fiber stock suspension across the web width of the papermaking machine by locally varying the width of the delivery slice or gap and/or by locally varying the density of the infed fiber stock suspension, substantially simultaneously adjusting the flow of the fiber stock suspension in the headbox apparatus such that, as viewed across the web width of the papermaking machine, the horizontal components of the flow direction of the infed fiber stock suspension at the delivery slice or gap throughout extend substantially parallel to the predetermined direction of the papermaking machine and the flow velocity at the delivery slice or gap, as viewed across the web width of the papermaking machine, corresponds to a predetermined profile, e.g. is at least approximately the same.

This can be achieved, for example, by selectively varying the pressure profile in the distribution box or distributor, by varying the geometry of the distribution box or distributor, the diffusor or guide system, or the nozzle chamber, or by infeeding fiber stock suspension or water into the distribution box or distributor, the diffusor or guide system or the nozzle chamber, or by withdrawing infed fiber stock suspension from the distribution box or distributor, the diffusor or guide system or the nozzle chamber, either individually or in combination with each other.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
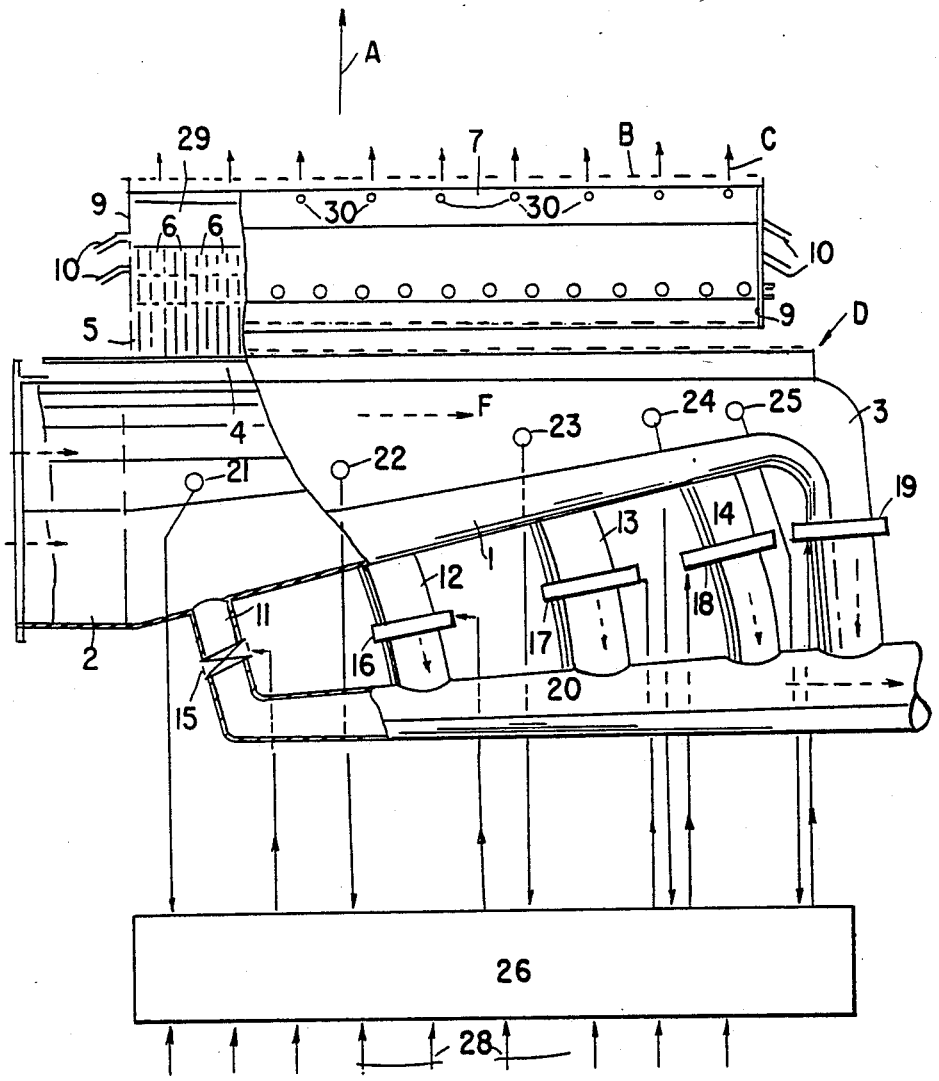
FIG. 1 is a partially cut-away view of a first exemplary embodiment of the inventive headbox apparatus.

Describing now the drawings, it is to be understood that to simplify the showing thereof, only enough of the structure of the headbox apparatus for a papermaking machine has been illustrated therein as is needed to enable one skilled in the art to readily understand the underlying principles and concepts of this invention. The papermaking machine defines a predetermined machine direction A and a predetermined web width B and produces a paper web like the paper web 68 shown in FIG. 5, from an infed fiber stock suspension which flows through the headbox apparatus. Turning now specifically to FIG. 1 of the drawings, a first embodiment of the inventive headbox apparatus illustrated therein by way of example and not limitation and operating according to the inventive method will be seen to comprise a distribution box or distributor 1 whose cross-section decreases in the flow direction F of the infed fiber stock suspension. Such infed fiber stock suspension is understood to constitute, e.g. a mixture of fibers containing additives for fabricating paper or cardboard, however, also filler stock suspensions for coating paper. The distribution box or distributor 1 distributes the infed fiber stock suspension across the predetermined web width B. At the infeed end of the distributor 1 and which infeed end has the larger cross-section, a connecting tube or infeed conduit 2 is connected for infeeding the fiber stock suspension of a predetermined stock density. At its other opposite end having the smaller cross-section, there is connected a return conduit 3. The distribution box or distributor 1 preferably possesses an approximately conical shape or may be constructed in the manner of a truncated pyramid.

A diffusor or guide system 5 is connected to one longitudinal side 4 of the distribution box or distributor 1. This diffusor or guide system 5, in principle, can be constructed as any desired diffusor or guide system conventionally employed in papermaking technology, for example, as sectionally illustrated in FIG. 1, as a stepped diffusor or guide system having a plurality of step-wise diverging substantially parallel diffusor channels 6, e.g. according to Swiss Patent No. 518,406 cognate with U.S. Pat. No. 3,725,197.

At the output of these diffusor channels 6, there is connected a nozzle chamber 29 containing side walls 9 and a delivery slice or gap 8 formed by two lips 7 or by one lip and a diaphragm mounted at the one lip but freely movable relative to the one lip. The infed stock suspension thus reaches the sieve part of the papermaking machine via the diffusor channels 6, the nozzle chamber 29 and the delivery slice or gap 8. The delivery slice or gap 8 distributes the infed fiber stock suspension at a predetermined weight per unit area or mass distribution across the predetermined web width B.

At least one of the lips 7 or the aforementioned diaphragm mounted at one such lip is provided with a number of adjusting means or devices 30 distributed across the predetermined web width B. By means of such adjusting means or devices 30 the opening width h (see FIG. 5) can be individually adjusted across the predetermined width B either manually or by means of a regulating device in order to locally alter, by means of locally altering the mass flow of the infed fiber stock suspension issuing from the delivery slice or gap 8, a desired oven-dry weight-per-unit-area distribution or profile of the thus produced paper web across its width.

However, if the opening width h of the delivery slice or gap 8 is locally changed at the delivery slice or gap 8 using the adjusting means or devices 30, there are also changed the local flow conditions such as pressure and velocity in the nozzle chamber 29 in addition to the local mass flow of the infed fiber stock suspension and the weight-per-unit-area distribution or profile. The result of the pressure differences are transverse flows in the nozzle chamber 29 and such transverse flows are present up to the delivery slice or gap 8 and act upon the fiber disposition at the sieve of the papermaking machine until the whole fiber formation is fixed in the paper sheet or blade. Due to the various transverse flows across the predetermined web width B defined by the papermaking machine, there results thus a variable fiber disposition in the paper sheet or blade across the predetermined web width B.

In order to prevent such transverse flows of the infed fiber stock suspension, certain precautions are necessary. One such precaution consists in controlling or regulating the pressure or pressure profile of the infed fiber stock suspension across the predetermined web width B of the papermaking machine or the width of the nozzle chamber 29 while maintaining or simultaneously with changing the adjusted profile of the opening width h of the delivery slice or gap 8. Otherwise, however, at constant opening width h or instead of such and simultaneously with a change in the opening width h, the predetermined stock density of the infed fiber stock suspension can be locally varied such that the desired transverse oven-dry weight per unit area distribution or profile is formed across the predetermined web width B at constant pressure. For this purpose, fiber stock suspension or water is required to be infed or withdrawn at suitable locations and individually distributed across the predetermined web width B.

Another phenomenon which has an effect similar to the variation in the opening width h of the delivery slice or gap 8, is brought about by a pressure drop or loss in the stock suspension and which pressure loss additionally occurs in the marginal zones of the papermaking machine due to friction losses at the side walls 9. Instead of compensating this pressure drop or loss by infeeding fiber stock suspension or water through the side walls 9 via additional conduits 10, which implies a considerable complication in terms of machinery and control techniques, the required compensation can be implemented in a simpler and more precise manner. This is achieved by means of the same pressure regulation, stock density regulation or the geometry variation as mentioned hereinbefore for maintaining the predetermined weight-per-unit-area distribution or profile and substantially uniform fiber orientation. In the same manner, the shrinking appearing at the margins of paper webs during drying, can be compensated so that a uniform paper web is formed across the whole width of the paper web.

In the inventive headbox apparatus, the aforementioned precautions are generally taken by providing flow control means generally designated by the reference character D and such flow control means D control the flow or throughpassage of the infed fiber stock suspension through the inventive headbox apparatus. Specifically, the flow control means contain adjusting means for adjusting the opening width h of the delivery slice or gap 8 such that there is obtained the predetermined weight per unit area or mass flow distribution across the predetermined web width B. The flow control means further contain control means to be described in detail hereinbelow are structured for controlling the flow or throughpassage of the infed fiber stock suspension through the inventive headbox apparatus in a manner such that, as viewed across the predetermined web width B, the substantially horizontal flow direction components C of the fiber stock suspension issuing from the delivery slice or gap 8, extend substantially parallel and in the predetermined machine direction A of the papermaking machine throughout the delivery slice or gap 8 of the nozzle chamber 29. Furthermore, such control means control the flow or throughpassage of the infed fiber stock suspension through the headbox apparatus such that the flow rate of the infed fiber stock suspension assumes a predetermined profile across the predetermined web width B.

More specifically, the aforementioned control means can be structured to control the flow or throughpassage of the infed fiber stock suspension through the inventive headbox apparatus in such a manner that the flow rates as well as the pressures which prevail in an inlet region 29A and in an outlet region 29B (see FIG. 6) of the nozzle chamber 29 are substantially equalized across the predetermined web width B. Furthermore, the aforementioned control means may also be structured to control the flow of the infed fiber stock suspension such that at least at preselected locations across the predetermined web width B at preselected locations along the length E of the nozzle chamber 28 or as viewed in the predetermined machine direction A, the flow rate and the prevailing pressure are substantially equal.

Generally, the aforementioned control means of the flow control means D comprise throughpass means for throughpassing a preselected liquid like the infed fiber stock suspension, further fiber stock suspension or water. Such throughpass means can be selectively connected to either one or a combination of the distribution box or distributor 1, the diffusor or guide system 5 and the nozzle chamber 29. The control means further comprise devices for varying one or a combination of (i) the pressure profile prevailing in the distribution box or distributor 1, (ii) the geometrical dimensions of individual ones or a combination of the distribution box or distributor 1, the diffusor or guide system 5, and the nozzle chamber 29, and (iii) the throughpassage of the infed fiber stock suspension through individual ones or a combination of the distribution box or distributor 1, the diffusor or guide system 5 and the nozzle chamber 29. Various such flow control means D will now be described in combination with reference to various exemplary embodiments of the inventive headbox apparatus.

In the first exemplary embodiment of the inventive headbox apparatus which contains the aforedescribed main elements, namely the distribution box or distributor 1, the diffusor or guide system 5 and the nozzle chamber 29, and which is illustrated in FIG. 1, the throughpass means of the flow control means constitute a predetermined number of branch conduits 11, 12, 13 and 14 on one longitudinal side of the distribution box or distributor 1 and across a predetermined width G (see FIG. 2) of the distribution box or distributor 1. The branch conduits 11, 12, 13 and 14 communicate with the interior of the distributor box or distributor 1. The control means further constitute, for varying the throughflow or throughpassage of liquid, a predetermined number of control devices, namely controllable valves 15, 16, 17, 18, 19 which are respectively provided in the branch conduits 11, 12, 13 and 14 and a return conduit 3.

The branch conduits 11, 12, 13 and 14 as well as the return conduit 3 are connected, for example, to a common collecting conduit 20. The branch conduits 11, 12, 13 and 14 thus constitute fiber stock suspension outfeed means and the controllable valves 15, 16, 17, 18 and 19 control the pressure prevailing in the infed fiber stock suspension. The fiber stock suspension branched-off at the individual connection points of the branch conduits 11, 12, 13 and 14 and through the return conduit 3, can be drained through this collecting conduit 20. Depending upon the quantity of the infed fiber stock suspension drained or returned through the individual branch conduits 11, 12, 13 and 14, the hydrostatic pressure profile or variation in the distribution box or distributor 1 is changed starting from the location of the connection of the different branch conduits 11, 12, 13 and 14. The extent of the pressure change is adjustable by means of the controllable valves 15, 16, 17, 18 and 19 so that the actuation of these controllable valves 15, 16, 17, 18 and 19 renders possible adjusting the required pressure profile or variation across the predetermined width G of the distribution box or distributor 1 or across the predetermined web width B of the papermaking machine. During this operation and due to the shape of the distribution box or distributor 1, a predetermined pressure profile or variation in the distribution box or distributor 1 can be initially and coarsely preset so that only the remaining deviations must be corrected by actuating the controllable valves 15, 16, 17, 18 and 19.

The pressure adjustment at the different adjustment points can be implemented manually by using visual pressure indicators, observing the produced paper web or measuring preselected paper web parameters or characteristics which have been determined by suitable measuring devices or sensors 69 (see FIG. 5) distributed transversely across the width of the paper web 68, e.g. the weight per unit area or the fiber orientation. As indicated in FIG. 1, the pressure adjustment also may be effected by means of a regulating device 26 which is controlled by the different measuring devices or sensors. For this purpose, pressure measuring devices or sensors 21, 22, 23, 24 and 25 are provided at the distribution box or distributor 1 along the flow direction F. By means of these pressure measuring devices or sensors 21, 22, 23, 24 and 25, the hydrostatic pressure of the infed fiber stock suspension prevailing in the distribution box or distributor 1 or its profile or variation in longitudinal direction, i.e. across the predetermined width G of the distribution box or distributor 1 can be determined.

Such pressure measuring devices or sensors 21, 22, 23, 24 and 25, in principle, can be constructed and arranged in any desired manner; the pressure measurement can also be implemented in the nozzle chamber 29. In the simplest case, the pressure measuring devices or sensors 21, 22, 23, 24 and 25 can be associated with and directly control the individual controllable valves 15, 16, 17, 18 and 19. The pressure measuring devices 21, 22, 23, 24 and 25 may feed their measured values independently of the controllable valves 15, 16, 17, 18 and 19 to the regulating device 26 which, for example, controls and regulates the individual controllable valves 15, 16, 17, 18 and 19 in a suitable manner by means of a conventional and therefore not particularly shown process control computer until the desired profile or pressure prevails at all measuring points.

Figure 5:
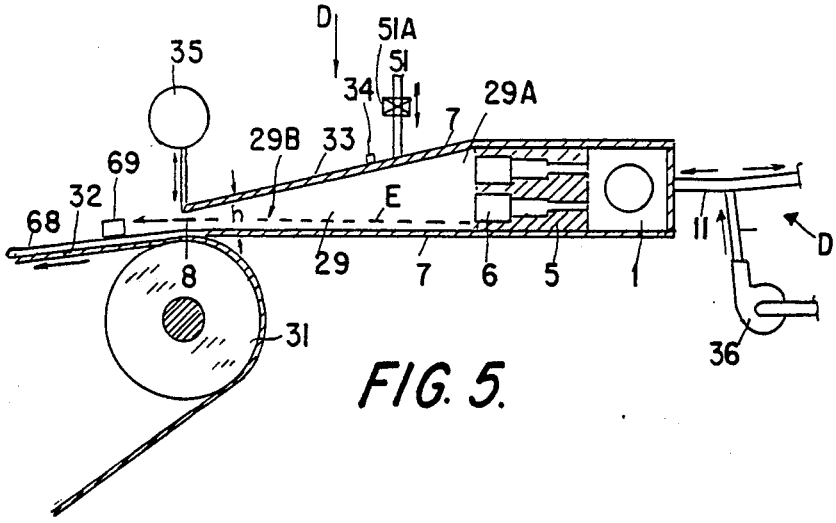
FIG. 5 is a vertical section through a fifth exemplary embodiment of the inventive headbox apparatus.

The pressure profile preset by the regulating device 26 can be selected such that the pressure shows a desired variation, e.g. is held constant across the whole predetermined width G of the distribution box or distributor 1. Also, certain margin-related corrections can be included, for example, a somewhat higher pressure at the two margins in order to compensate for pressure drops or losses at the side walls. Additionally, the regulating device 26 can also be controlled by further measuring devices or sensors 69 which, for example, determine or measure preselected parameters like the thickness, the weight per unit area, the curl (coiling tendency) or the fiber orientation of the produced paper web 68 across the predetermined web width B as shown in FIG. 5, and deliver corresponding additional control signals 28 by means of which an additional pressure correction can be implemented or the pressure profile can be further affected.

In the presence of suitable operating personnel, such control, however, can be effected in a simpler manner manually or semi-automatically by observing the measured values of the individual measuring devices or sensors and corresponding readjusting operations. Such simpler control is frequently sufficient because as a rule, a single readjustment is sufficient after start-up of the papermaking machine. Readjustment only becomes necessary when the operating parameters, e.g. the pressure or the composition of the infed fiber stock suspension, are changed or when the production is changed, e.g. when the papermaking machine is switched-over to a different type of fiber stock suspension which requires a change in the pressure profile or variation. In the heretofore known headbox apparatuses or systems this was only possible with difficulties and complications.

The branch conduits 11, 12, 13 and 14 may have various cross-sections in correspondence with the necessary correction. Likewise, various mutual spacings can be selected for these branch conduits 11, 12, 13 and 14. However, it is also readily possible to provide branch conduits of the same diameter at the same mutual spacing, particularly in a number ensuring the necessary controllability.

Instead of draining or returning part of the infed fiber stock suspension through the branch conduits 11, 12, 13 and 14, the branch conduits 11, 12, 13 and 14 may also serve for infeeding further fiber stock suspension, i.e. constitute further fiber stock suspension infeed means. In this case, an infeed conduit is provided instead of the common collecting conduit 20. This infeed conduit can be connected to the already present connecting tube or infeed conduit 2 or to infeed means separate therefrom. In such arrangement the controllable valves 15, 16, 17, 18, 19 for throughflow control are at least partially replaced by appropriate controllable pumps. If required, only part of the branch conduits 11, 12, 13 and 14 may serve for draining or returning infed fiber stock suspension whereas remaining branch conduits may infeed further fiber stock suspension. The control devices or members in such arrangement may be constructed such that the throughflow direction and the throughflow quantity are controllable.

Figure 2A:
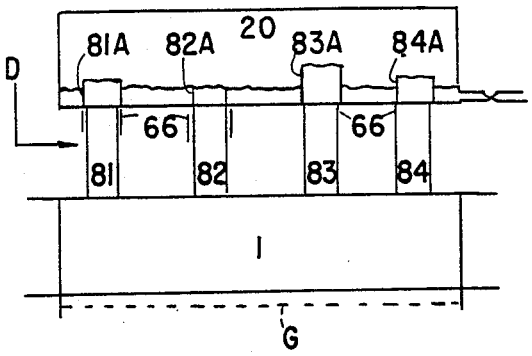
FIGS. 2A and 2B shows two different vertical sections through a second exemplary embodiment of the inventive headbox apparatus.
Figure 2B:
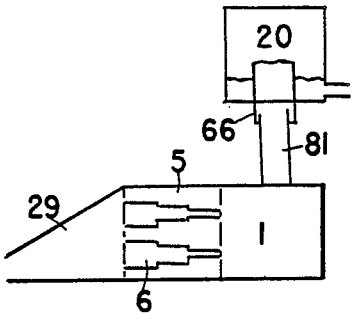

FIGS. 2A and 2B show a second exemplary embodiment of the inventive headbox apparatus in two vertical sections. In this embodiment, the throughpass means of the control means contain fiber stock suspension outfeed means constituted by a reservoir 20 arranged at a predetermined elevation relative to the distribution box or distributor 1 and a predetermined number of connecting conduits 81, 82, 83 and 84 which interconnect the distribution box or distributor 1 and the reservoir 20. End portions 81A, 82A, 83A and 84A of the respective connecting conduits 81, 82, 83 and 84 protrude into the reservoir 20 and are constructed such as to be adjustable in length. The control means further contain a predetermined number of adjusting devices 66, for example, sleeves which are externally displaceable or a telescopic construction for adjusting the variable length of the end portions 81A, 82A, 83A and 84A. There is thus provided a weir which is adjustable in elevation and thus the local pressures in the distribution box or distributor 1 are rendered individually adjustable.

Figure 3A:
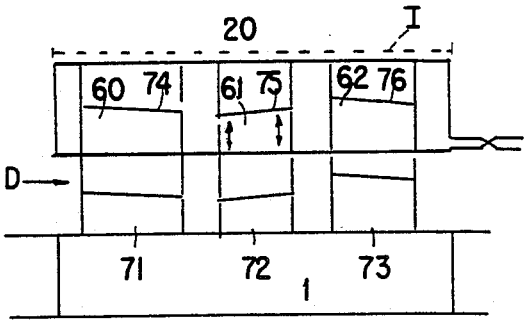
FIGS. 3A and 3B shows two different vertical sections through a third embodiment of the inventive headbox apparatus.
Figure 3B:
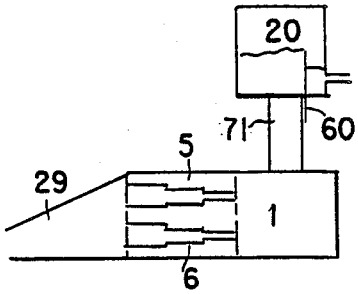

A third exemplary embodiment of the inventive headbox apparatus is also illustrated in two vertical sections in FIGS. 3A and 3B. In this embodiment, the control means of the flow control means D comprise fiber stock suspension outfeed means constituting a reservoir 20 having a predetermined width I, a predetermined number of openings or slots 71, 72 and 73 which provide communication between the distribution box or distributor 1 and the reservoir 20, and a predetermined number of overflow weirs 74, 75 and 76 which are operatively associated with respective ones of the openings or slots 71, 72 and 73. The control devices of the control means are constituted by a predetermined number of adjusting devices 60, 61 and 62 which are operatively associated with respective ones of the overflow weirs 74, 75 and 76. Each one of the overflow weirs 74, 75 and 76 can be adjusted to a predetermined overflow level in order to thereby provide a predetermined pressure profile prevailing in the distribution box or distributor 1.

Figure 4A:
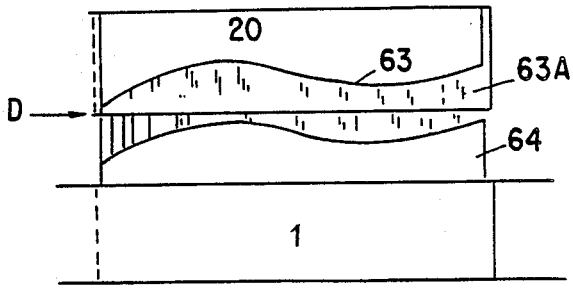
FIGS. 4A and 4B shows two different vertical sections through a third exemplary embodiment of the inventive headbox apparatus.
Figure 4B:
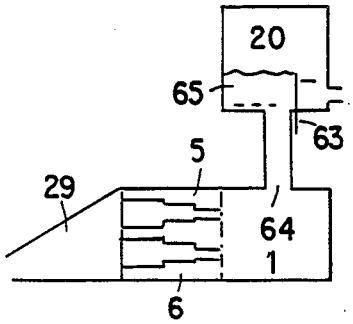

The fourth exemplary embodiment of the inventive headbox apparatus shown in FIGS. 4A and 4B is a variant of the construction illustrated in FIGS. 3A and 3B. Specifically, there is provided a single opening or outflow slot 64 which provides communication between a distribution box or distributor 1 and a reservoir 20 which is arranged at a predetermined elevation relative to the distribution box or distributor 1. The opening or outflow slot 64 thus constitutes the throughpass means or fiber stock suspension outfeed means of the control means of the flow control means D. The control means further contain an adjustable, preferably multi-membered overflow weir 63 and adjusting devices 63A for individually and locally adjusting the overflow level at the overflow weir 63 such that there is obtained the predetermined pressure profile in the distribution box or distributor 1. Instead of the overflow weir 63, there can also be provided a displaceable diaphragm 65 by means of which the opening or outflow slot 64 is individually adjustable across the predetermined width of the opening or outflow slot 64.

Instead of mounting the branch or connecting conduits or connecting opening or slots at the side of the distribution box or distributor 1, these elements, however, can also be provided at other locations of the headbox apparatus, for example, at the diffusor or guide system 5, or in the nozzle chamber 29 either immediately following the diffusor or guide system 5 or shortly preceding the delivery slice or gap 8 or also therebetween.

FIG. 5 shows in vertical section, a fifth exemplary embodiment of the inventive headbox apparatus which also is provided with a distribution box or distributor 1, a diffusor or guide system 5 containing a row of substantially parallel diffusor channels 6, and a nozzle chamber 29 containing a delivery slice or gap 8. The infed fiber stock suspension flows out from the nozzle chamber 29 onto a sieve 32 of a papermaking machine and the sieve 32 is guided by a breast roll 31. A front portion 33 of the upper limiting lip 7 of the nozzle chamber 29 is individually adjustable for adjusting the opening width h of the delivery slice or gap 8 by means of a joint 34 and an adjusting means or device 35 which constitutes the adjusting means of the flow control means D and which is distributed across the width of the delivery slice or gap 8. The delivery slice or gap 8 is frequently limited at the top by a conventional and therefore not shown diaphragm which is mounted at the upper limiting lip 7 but is freely movable to a certain extent relative to the upper limiting lip 7. The opening width of the delivery slice or gap 8 can then be changed by the adjusting means or devices 35 mounted at the diaphragm. The quantity of infed fiber stock suspension which flows out from the delivery slice or gap 8 can thus be locally and independently regulated across the predetermined web width B. The control means for infeeding or withdrawing of fiber stock suspension again contain branch conduits 11 to 14 as shown in FIG. 1 or the constructions as shown in FIGS. 2 to 4 at the distribution box or distributor 1 and the associated valves or pumps 36. Additionally or selectively, branch conduits 51 constitute throughpass means of the control means which extend to the nozzle chamber 29 and are provided with respective control devices 51A. The control means thus control the throughflow or throughpassage of the infed fiber stock suspension in a manner such that, as viewed across the predetermined web width B defined by the papermaking machine, the flow rate as well as the pressure prevailing in the nozzle chamber 29 are substantially equal at least at individual locations across the predetermined web width B along a predetermined length E of the nozzle chamber 29 or in the predetermined machine direction A. Also, the aforementioned control means may be adjusted such that there are substantially equalized the flow rates and the pressures prevailing in an inlet region 29A and an outlet region 29B of the nozzle chamber 29.

Figure 6:
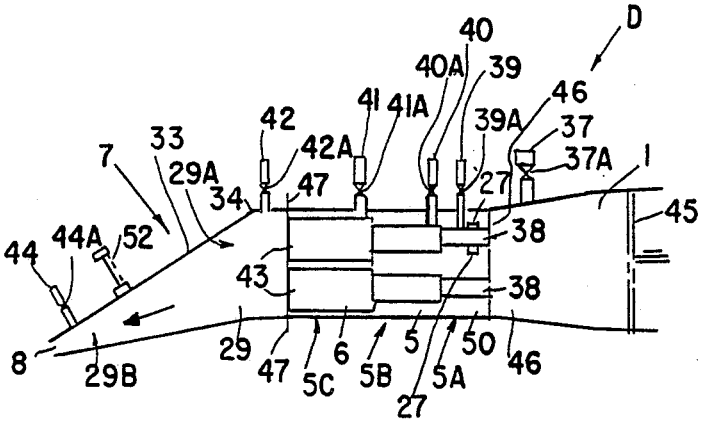
FIG. 6 is a vertical section through a sixth embodiment of the inventive headbox apparatus.

A sixth exemplary embodiment of the inventive headbox apparatus is schematically illustrated in section in FIG. 6. The headbox apparatus contains a distribution box or distributor 1, a diffusor or guide system 5 and a nozzle chamber 29 which are series-connected and through which an infed fiber stock suspension is passed to a sieve like the sieve 32 shown in FIG. 5 or any other component of the papermaking machine. In this particular embodiment, the flow control means D are structured and arranged such that any effects on the desired pressure profile or variation across the predetermined web width B can be compensated as closely as possible to its location of origin.

In the illustrated embodiment, control means acting upon the distribution box or distributor 1 encompass throughpass means or conduits 37 and the associated control devices constitute throughflow control means 37A. Such throughpass means or conduits 37 are arranged at the top side or any other appropriate location at the distribution box or distributor 1. Preferably, the throughpass means or conduits 37 are connected with the distribution box or distributor 1 in the immediate proximity of inlet openings 38 of the diffusor or guide system 5 which follows the distribution box or distributor 1.

Instead of the controlled throughpass means or conduits 37 or in combination therewith, the control means can also be provided to act upon the diffusor or guide system 5. In the illustrated embodiment, for example, throughpass means or conduits 39 of the control means contain control devices constituting throughflow control means 39A and lead to a first diffusor stage 5A of the multi-stage diffusor or guide system 5. Further throughpass means or conduits 40 containing throughflow control means 40A lead to a second diffusor stage 5B which immediately follows the first diffusor stage 5A. Still further throughpass means or conduits 41 containing throughflow control means 41A lead to a third diffusor stage 5C which immediately follows the second diffusor stage 5B. Preferably, each one of the further throughpass means or conduits 40 and 41 is connected to the respective preceding diffusor stage 5B and 5C in close proximity to the respective immediately preceding diffusor stage 5A and 5B.

Control means acting upon the nozzle chamber 29 may constitute, for example, throughpass means or conduits 42 containing throughflow control means 42A and opening into the inlet region 29A of the nozzle chamber 29 and this inlet region 29A follows immediately outlet openings 43 of the diffusor channels 6 in the diffusor or guide system 5. Such control means may further contain throughpass means or conduits 44 provided with throughflow control means 44A and opening into the movable portion 33 of the upper lip 7 in the vicinity of the delivery slice or gap 8 of the nozzle chamber 29.

According to the prevailing requirements for controlling the pressure or the stock density of the infed fiber stock suspension, the aforementioned throughpass means or conduits 37, 39, 40, 41, 42 and 44 may constitute further fiber stock suspension infeed means, fiber stock suspension outfeed means, water infeed means or infeed means for infeeding sieve water which has a lower stock density or contains less fiber stock than the infed fiber stock suspension.

A further possibility of regulating the pressure in the distribution box or distributor 1 can be provided by changing the cross-section of the distributor box or distributor 1, e.g. by a displaceably constructed rear wall 45 of the distribution box or distributor 1. The displaceability can be achieved due to the fact that the rear wall 45 is displaceable, either manually or by means of a regulating device, across the predetermined width G of the distribution box or distributor 1 whereby the pressure profile in the distribution box or distributor 1 can be adjusted. The rear wall 45 also can be constructed as a flexible and deformable membrane which is automatically adjusted, for example, by means of a pressure cushion at the rear side such that the same pressure prevails across the whole predetermined width G of the distribution box or distributor 1.

In combination with preselected ones of the aforementioned control or adjusting and regulating means or devices or even solely, an alteration of the geometry of the nozzle chamber 29 can be necessary for achieving equal flow rates and equal pressures across the width of the nozzle chamber 29. Therefore, adjusting means 52 are required as the control means and must be provided either immediately following the diffusor or guide system 5, preceding the delivery slice or gap or also therebetween. The adjusting means or devices 52 can also be mounted at two and more positions as viewed in the predetermined machine direction A and act upon a hingedly connected portion 33 of the upper lip 7.

Further control means of the flow control means constitute adjustable throughflow control elements like displaceable diaphragms 46 which are provided in front of the inlet openings 38 of the diffusor channels 6 or corresponding adjustable throughflow control elements like displaceable diaphragms 47 in front of the outlet openings 43 of the diffusor channels 6. These displaceable diaphragms 46 and 47 may constitute displaceable elements, iris diaphragms, inflatable bodies or other elements.

Further fiber stock suspension or water can also be infed through throughpass means or conduits 50 directly at the inlet openings 38 of the diffusor channels 6. The diffusor channels 6 can be constricted by control means constituting adjusting means such as controllable pressure bodies 27.

The increased pressure drop or loss at the marginal zones of the nozzle chamber 29, e.g. due to friction at the side walls 9, can be compensated by changing, for example, by reducing the pressure drop or loss in the marginal zones 48 of the diffusor or guide system 5 and this is achieved by altering the throughflow cross-section per unit width.

Figure 7:
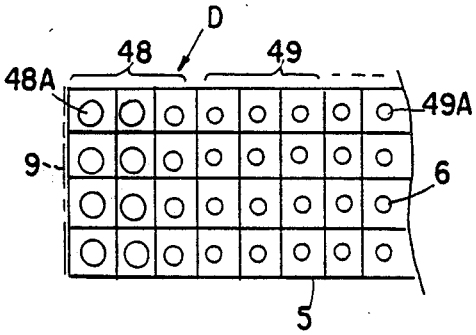
FIG. 7 is a cross-sectional view of the diffusor or guide system in a seventh exemplary embodiment of the inventive headbox apparatus.

FIG. 7 shows a seventh exemplary embodiment of the inventive headbox apparatus comprising a diffusor or guide system block 5 containing a number of rows of stepped diffusor channels 6 which are uniformly arranged on top of each other. The flow control means D contain control means for reducing the pressure drop or loss of the diffusor channels 6 in the marginal zones 48. The cross-sectional area 48A of the diffusor channels 6 is greater in the marginal zones 48 at the side walls 9 than the cross-sectional area 49A of the diffusor channels 6 in the central zone 49. Consequently, the pressure drop or loss in the infed fiber stock suspension is somewhat smaller in the marginal zones 48 than in the central zone 49 and there are thus compensated the increased pressure drop or losses in the marginal zones 48 of which only one is shown in FIG. 7.

Figure 8:
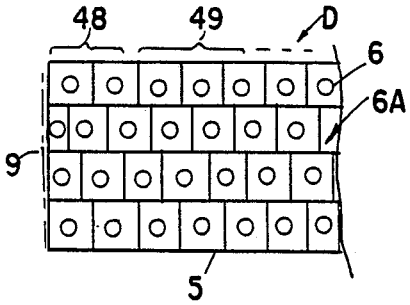
FIG. 8 is a cross-sectional view of the diffusor or guide system in an eighth embodiment of the inventive headbox apparatus.

In the diffusor or guide system 5 of an eighth exemplary embodiment of the inventive apparatus illustrated in FIG. 8, the control means contain individual rows 6A of diffusor channels 6 which may constitute stepped diffusor channels 6 of the type as shown in FIG. 6, are offset from each other, which implies that there is built up in the marginal zones 48 a lower nozzle pressure due to the smaller number of diffusor channels 6 which are present in the marginal zones 48 of which only one is illustrated in FIG. 8 as compared to the number of diffusor channels 6 present in the central zone 49. A greater stock mass flow per unit width can be achieved in the marginal zones 48 by providing additional bores or by reducing the pressure drop or loss of the individual elements or diffusor channels 6 of the diffusor or guide system 5 in the marginal zones 48 so that a pressure correction is also possible in this arrangement.

In this manner, basic deficiencies of the lay-out of the distribution box or distributor 1 or at other locations of the papermaking machine can be compensated by changing and matching the bore or diffusor channel diameter or the pressure drop or loss across the predetermined web width B.

Figure 9:
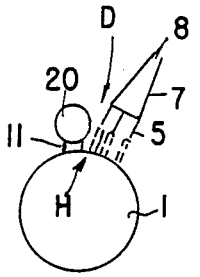
FIG. 9 is a schematic illustration of a ninth exemplary embodiment of the inventive headbox apparatus.

Variations and advantageous further developments are possible within the scope of the inventive concept. Thus, as shown for the ninth exemplary embodiment of the inventive headbox apparatus in FIG. 9, the branch conduits 11 connected with the common collecting conduit 20 advantageously can be connected to the region of the point H of the highest elevation of the distribution box or distributor 1. It is thereby ensured that air which may have separated can be reliably removed. The connection for the diffusor or guide system 5 can be provided immediately adjacent thereto so that the pressure regulation is implemented in the immediate proximity of the inlet openings 38 of the diffusor or guide system 5.

The common collecting conduit 20 can also be passed directly across the predetermined width G of the distribution box or distributor 1 so that the branch conduits 11 to 14 are formed by openings which connect the distribution box or distributor 1 and the common collecting conduit 20.

Figure 10:
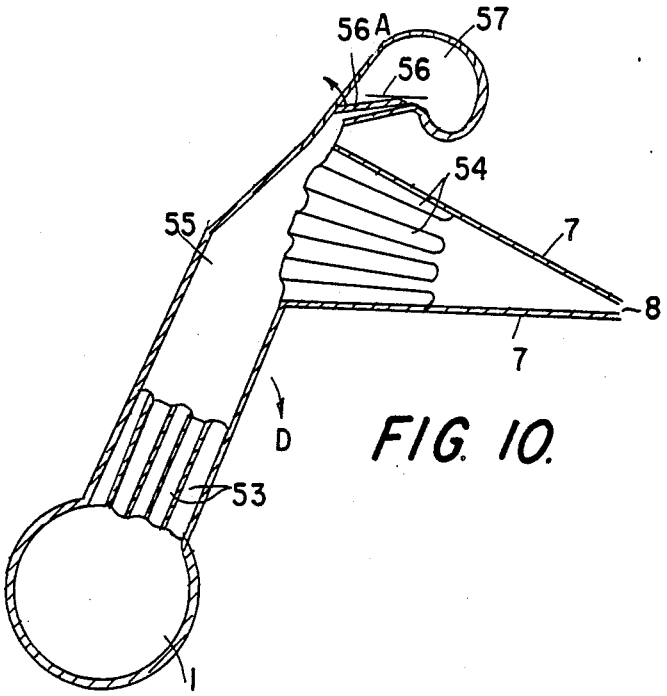
FIG. 10 is a schematic sectional illustration of a tenth exemplary embodiment of the inventive headbox apparatus.

FIG. 10 shows a tenth exemplary embodiment of the inventive headbox apparatus wherein a diffusor or guide system connects a distribution box or distributor 1 with the lips 7 of a nozzle chamber 29 comprising a delivery slice or gap 8. The diffusor or guide system comprises two series-connected diffusor tube systems 53 and 54 which are separated by an intermediate space 55 diverting the infed fiber stock suspension. This intermediate space 55 is connected with control means containing an overflow conduit 57, throughpass means in the form of branch openings 56 and adjusting devices 56A independently controlling the cross-sectional areas of the individual branch openings 56. The overflow conduit 57 simultaneously shows a damping action.

Figure 11:
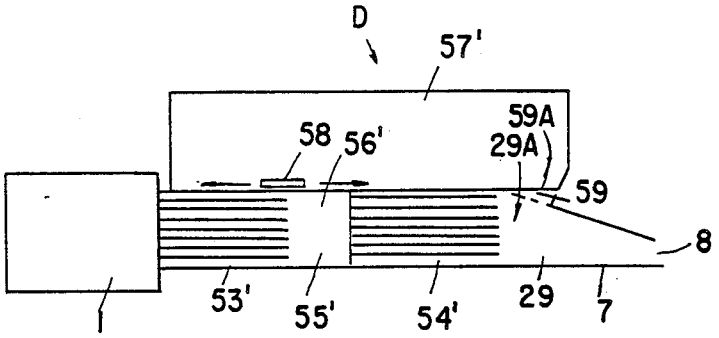
FIG. 11 is a schematic partially sectional view of an eleventh exemplary embodiment of the inventive headbox apparatus.

FIG. 11 shows an analogous eleventh exemplary embodiment of the inventive headbox apparatus wherein the flow control means D contain control means comprising branch openings 56', which interconnect as throughpass means an intermediate space 55' between two diffusor tube systems 53' and 54' and an overflow conduit 57', and control devices in the form of adjustable sliders 58 for adjusting the cross-sectional areas of the openings 56'. Optionally, the control means may further contain further openings 59 and associated adjusting means 59A can be in the inlet region 29A of the nozzle chamber 29.

While there are shown and described present preferred embodiments of the invention, it is to be distinctly understood that the invention is not limited thereto, but may be otherwise variously embodied and practiced within the scope of the following claims.

What we claim is:

1. A headbox apparatus for a papermaking machine defining a predetermined machine direction and a predetermined web width and for producing a paper web from an infed fiber stock suspension passed through the headbox apparatus, said headbox apparatus comprising:

a distribution box for distributing an infed fiber stock suspension across the predetermined web width;

a diffusor system following said distribution box and receiving the infed fiber stock suspension from said distribution box;

said diffusor system possessing a plurality of diffusor channels for throughpassing the infed fiber stock suspension through said diffusor system;

a nozzle chamber following and flow communicating with said diffusor system;

said nozzle chamber receiving said infed fiber stock suspension from said diffusor system and containing a delivery slice for throughpassing said infed fiber stock suspension;

said delivery slice distributing said infeed fiber stock suspension at substantially a predeterminate weight per unit area distribution across said predetermined web width;

said delivery slice having a preselectable opening width;

said infed fiber stock suspension, during operation of the headbox apparatus, flowing through said headbox apparatus at a predeterminate flow rate and in a flow direction defining substantially horizontal flow direction components;

flow control means for controlling said predeterminate weight per unit area distribution of said infed fiber stock suspension across said predetermined web width, said predeterminate flow rate of said infed fiber stock suspension across said predetermined web width, and the alignment of said substantially horizontal flow direction components of said flow direction of the infed fiber stock suspension with the predetermined machine direction across said predetermined web width;

said flow control means comprising:

adjusting means for adjusting said preselectable opening width of the delivery slice of said nozzle chamber in a manner such that there is obtained said predeterminate weight per unit area distribution across said predetermined web width;

control means for controlling said predeterminate flow rate of said infed fiber stock suspension across said predetermined web width and the alignment with said predetermined machine direction of said substantially horizontal flow direction components of the flow direction of said infed fiber stock suspension across said predetermined web width;

said control means including structure for controlling said predeterminate flow rate and the alignment with said predetermined machine direction of said substantially horizontal flow direction components of said infed fiber stock suspension substantially simultaneously with a change in the adjustment of said adjusting means for adjusting said preselectable opening width of the delivery slice of said nozzle chamber;

said distribution box having a predetermined geometrical configuration across said predetermined web width;

said nozzle chamber having a predetermined geometrical configuration across said predetermined web width;

said control means containing adjusting means effective across said predetermined web width for selectively locally individually adjusting said predeterminate geometrical configuration of either said distribution box or said nozzle chamber; and said control means further including means for the selective infeed or outfeed of a fluid medium to at least one of said distribution box and said nozzle chamber.

2. The headbox apparatus as defined in claim 1, wherein:

said control means further including means for the selective infeed or outfeed of a fluid medium to at least one of said distribution box, said diffusor system and said nozzle chamber.

3. The headbox apparatus as defined in claim 1, wherein:

said nozzle chamber defines an inlet region flow communicating with said diffusor system and an outlet region flow communicating with said delivery slice;

said infed fiber stock suspension, during operation of the headbox apparatus, flowing through said inlet region and said outlet region of said nozzle chamber at respective flow rates and under respective pressures; and said control means controlling said flow of said infed fiber stock suspension through said nozzle chamber in a manner such that the flow rates and the pressures prevailing in said inlet region and in said outlet region of said nozzle chamber are substantially equalized across said predetermined web width.

4. The headbox apparatus as defined in claim 1, wherein:

said nozzle chamber defines a predetermined length between said diffusor system and said delivery slice;

said infed fiber stock suspension, during operation of said headbox apparatus, flowing along said predetermined length of said nozzle chamber at a predeterminate flow rate and under a prevailing pressure; and said control means controlling said flow of said infed fiber stock suspension along said predetermined length of said nozzle chamber in a manner such that, at least at individual locations in said nozzle chamber across said predetermined web width at preselected locations along said predetermined length of said nozzle chamber, said predeterminate flow rate and said prevailing pressure are substantially equal.

5. The headbox apparatus as defined in claim 1, wherein:

each one of said distribution box, said diffusor system and said nozzle chamber having predetermined geometrical dimensions;

said control means being operatively associated with at least one of said distribution box, said diffusor system and said nozzle chamber;

said distribution box having a predetermined width;

said infed fiber stock suspension, during operation of the headbox apparatus, passing through said distribution box at a predeterminate pressure profile across said predetermined width of said distribution box; and said control means controlling said predeterminate flow rate and said alignment with said predetermined machine direction of said substantially horizontal flow direction components of said infed fiber stock suspension across said predetermined web width by varying at least one of (i) said pressure profile prevailing in said distribution box, (ii) the geometrical dimensions of at least one of said distribution box, said diffusor system and said nozzle chamber, and (iii) the throughpassage of said infed fiber stock suspension through at least one of said distribution box, said diffusor system and said nozzle chamber.

6. The headbox apparatus as defined in claim 5, wherein:

said control means contain throughpass means for throughpassing fiber stock suspension;

said throughpass means being distributed across said predetermined width of said distribution box;

said control means further containing a plurality of control devices for controlling the throughpassage of fiber stock suspension through said throughpass means; and said plurality of control devices controlling at least one of (i) said predeterminate pressure profile prevailing in said distribution box across said predetermined width of said distribution box and (ii) the quantity of said infed fiber stock suspension delivered by said distribution box.

7. The headbox apparatus as defined in claim 6, wherein:

said throughpass means comprise a plurality of branch conduits connected with said distribution box.

8. The headbox apparatus as defined in claim 6, wherein:

said throughpass means include said selective infeed or outfeed means for the fluid medium.

9. The headbox apparatus as defined in claim 7, wherein:

said distribution box possesses a point of highest elevation; and said plurality of branch conduits being connected to said distribution box in the region of said point of highest elevation.

10. The headbox apparatus as defined in claim 6, wherein:

said diffusor system possesses a plurality of inlet openings; and said throughpass means being connected with said distribution box in the immediate proximity of said plurality of inlet openings of said diffusor system.

11. The headbox apparatus as defined in claim 6, wherein:

said throughpass means contain a reservoir;

said reservoir being arranged at a predetermined elevation relative to said distribution box;

said reservoir having a predetermined width;

said throughpass means further containing at least one opening interconnecting said distribution box and said reservoir across said predetermined width of said reservoir;

said plurality of control devices containing at least one overflow weir;

said at least one overflow weir being operatively associated with said at least one opening and extending across said predetermined width of said reservoir; and said plurality of control devices containing at least one adjusting device for adjusting said at least one overflow weir to a preselected overflow level.

12. The headbox apparatus as defined in claim 11, wherein:

said at least one adjusting device locally adjusts said at least one overflow weir to local overflow levels at predetermined locations across said predetermined width of said reservoir.

13. The headbox apparatus as defined in claim 11, wherein:

said at least one overflow weir constitutes a plurality of overflow weirs distributed across said predetermined width of said reservoir; and said at least one adjusting device constituting a plurality of adjusting devices for individually adjusting the overflow levels at respective ones of said plurality of overflow weirs.

14. The headbox apparatus as defined in claim 1, wherein:

said control means contain throughpass means connected to said diffusor system; and said control means further containing a plurality of control devices for controlling the throughflow through said throughpass means.

15. The headbox apparatus as defined in claim 14, wherein:

said diffusor system constitutes a multi-stage diffusor system;

said multi-stage diffusor system containing, as said plurality of diffusor channels, a plurality of stepped diffusor channels;

said multi-stage diffusor system containing a first diffusor stage communicating with said distribution box; and said throughpass means being connected to at least one predetermined stepped diffusor channel at least in said first diffusor stage of said multi-stage diffusor system.

16. The headbox apparatus as defined in claim 15, further including:

further throughpass means connected to said at least one predetermined stepped diffusor channel in at least one further diffusor stage of said multi-stage diffusor system; and said further throughpass means being connected to said at least one predetermined stepped diffusor channel in said at least one further diffusor stage in close proximity to an immediately preceding diffusor stage of said multi-stage diffusor system.

17. The headbox apparatus as defined in claim 14, wherein:

said plurality of diffusor channels in said diffusor system define respective inlet openings; and said throughpass means being connected to at least one of said plurality of diffusor channels in the region of said inlet opening of said at least one diffusor channel.

18. The headbox apparatus as defined in claim 14, further including:

marginal zones defined in said diffusor system;

a predetermined number of said plurality of diffusor channels of said diffusor system being associated with said marginal zones of said diffusor system; and said throughpass means being connected to said predetermined number of diffusor channels associated with said marginal zones of said diffusor system.

19. The headbox apparatus as defined in claim 5, wherein:

said diffusor system contains a plurality of inlet openings communicating with said distribution box and a plurality of outlet openings communicating with said nozzle chamber;

said control means constituting respective adjustable throughflow control elements operatively associated with said plurality of inlet openings.

20. The headbox apparatus as defined in claim 5, wherein:

said diffusor system contains a plurality of inlet openings communicating with said distribution box and a plurality of outlet openings communicating with said nozzle chamber; and said control means constituting respective adjustable throughflow control elements operatively associated with said plurality of outlet openings.

21. The headbox apparatus as defined in claim 5, wherein:

said plurality of diffusor channels of said diffusor system comprising diffusor channels having different cross-sectional areas as viewed across said predetermined web width; and said control means being constituted by said diffusor channels of different cross-sectional areas.

22. The headbox apparatus as defined in claim 21, wherein:

said diffusor system defines marginal zones and a central zone;

said plurality of diffusor channels having different cross-sectional areas in said marginal zones and said central zone; and a plurality of diffusor channels associated with said marginal zones of said diffusor system possessing larger cross-sectional areas than the cross-sectional areas of a further plurality of diffusor channels associated with said central zone of said diffusor system.

23. The headbox apparatus as defined in claim 22, wherein:

said diffusor system having a predetermined width; and said diffusor system possessing substantially the same number of said diffusor channels per unit of said predetermined width of said diffusor system in said marginal zones and in said central zone.

24. The headbox apparatus as defined in claim 5, further including:

marginal zones and a central zone of said diffusor system;

each one of said plurality of said diffusor channels of said diffusor system possessing a predeterminate pressure drop;

a predetermined number of said plurality of diffusor channels being associated with said marginal zones of said diffusor system;

a predetermined number of said plurality of diffusor channels being associated with said central zone of said diffusor system; and said control means comprising said predetermined number of diffusor channels associated with said marginal zones of said diffusor system and having a smaller pressure drop than the pressure drop of said predetermined number of diffusor channels which are associated with said central zone of said diffusor system.

25. The headbox apparatus as defined in claim 5, wherein:

said control means being operatively associated with said diffusor system; and said control means comprising adjusting means operatively associated with at least one predetermined diffusor channel of said plurality of diffusor channels for adjustably constricting said at least one predetermined diffusor channel.

26. The headbox apparatus as defined in claim 14, wherein:

said throughpass means contain an overflow conduit;

said overflow conduit being arranged at a predetermined elevation above said distribution box;

said diffusor system containing two diffusor tube systems;

said two diffusor tube systems being interconnected by an intermediate chamber;

said intermediate chamber being connected to said overflow conduit through a branch opening;

said plurality of control devices containing a plurality of adjusting devices each of which is operatively associated with said branch opening.

27. The headbox apparatus as defined in claim 26, wherein:

said nozzle chamber defines an inlet region;

said inlet region being connected to said overflow conduit through an opening; and said plurality of control devices contain a plurality of further adjusting devices each of which is operatively associated with the opening interconnecting said inlet region of said nozzle chamber and said overflow conduit.

28. The headbox apparatus as defined in claim 1, wherein:

said control means contain throughpass means connected with said nozzle chamber; and said control means further containing a plurality of control devices controlling the throughflow through said throughpass means.

29. The headbox apparatus as defined in claim 28, wherein:

said nozzle chamber defines an inlet region flow communicating with said diffusor system; and said throughpass means constituting a plurality of conduits connected to said inlet region of said nozzle chamber.

30. The headbox apparatus as defined in claim 28, wherein:

said nozzle chamber defines an outlet region flow communicating with said delivery slice of said nozzle chamber;

said throughpass means constituting a plurality of conduits connected with said outlet region of said nozzle chamber.

31. The headbox apparatus as defined in claim 1, wherein:

said nozzle chamber being bounded on one side by an upper lip;

at least a portion of said upper lip bounding one side of said nozzle chamber being hingedly mounted by means of a hinged connection; and said adjusting means pivotably adjusting at least said portion of said upper lip about said hinged connection.

32. The headbox apparatus as defined in claim 1, wherein:

said control means contain a plurality of measuring devices for measuring the hydrostatic pressure of said infed fiber stock suspension; and said plurality of measuring devices being distributed across said predetermined web width.

33. The headbox apparatus as defined in claim 32, wherein:

said distribution box has a predetermined width;

said control means contain throughpass means for throughpassing fiber stock suspension;

said throughpass means being distributed across said predetermined width of said distribution box;

said control means further containing a plurality of control devices for controlling the throughpassage of fiber stock suspension through said throughpass means;

a regulating device operatively associated with said plurality of control devices for regulating at least one of the throughpassage and the throughpassage direction of said fiber stock suspension through said throughpass means; and said regulating device being controlled by said plurality of measuring devices.

34. The headbox apparatus as defined in claim 33, wherein:

said control means contain further measuring devices for selectively measuring, across said predetermined web width, preselected parameters of the paper web produced by means of the headbox apparatus; and said further measuring devices controlling said regulating device.

35. The headbox apparatus as defined in claim 34, wherein:

said further measuring devices contain structure to measure, as said preselected parameter, the weight per unit area of said produced paper web.

36. The headbox apparatus as defined in claim 34, wherein:

said further measuring devices contain structure to measure, as said preselected parameter, the fiber orientation of said produced paper web.

37. A headbox apparatus for a papermaking machine defining a predetermined machine direction and a predetermined web width and for producing a paper web from an infed fiber stock suspension passed through the headbox apparatus, said headbox apparatus comprising:

a distribution box for distributing an infed fiber stock suspension across the predetermined web width;

a diffusor system following said distribution box and receiving the infed fiber stock suspension from said distribution box;

said diffusor system possessing a plurality of diffusor channels for throughpassing the infed fiber stock suspension through said diffusor system;

a nozzle chamber following and flow communicating with said diffusor system;

said nozzle chamber receiving said infed fiber stock suspension from said diffusor system and containing a delivery slice for throughpassing said infed fiber stock suspension;

said delivery slice distributing said infeed fiber stock suspension at substantially a predeterminate weight per unit area distribution across said predetermined web width;

said delivery slice having a preselectable opening width;

said infed fiber stock suspension, during operation of the headbox apparatus, flowing through said headbox apparatus at a predeterminate flow rate and in a flow direction defining substantially horizontal flow direction components;

flow control means for controlling said predeterminate weight per unit area distribution of said infed fiber stock suspension across said predetermined web width, said predeterminate flow rate of said infed fiber stock suspension across said predetermined web width, and the alignment of said substantially horizontal flow direction components of said flow direction of the infed fiber stock suspension with the predetermined machine direction across said predetermined web width;

said flow control means comprising:

adjusting means for adjusting said preselectable opening width of the delivery slice of said nozzle chamber in a manner such that there is obtained said predeterminate weight per unit area distribution across said predetermined web width;

control means for controlling said predeterminate flow rate of said infed fiber stock suspension across said predetermined web width and the alignment with said predetermined machine direction of said substantially horizontal flow direction components of the flow direction of said infed fiber stock suspension across said predetermined web width;

said control means including structure for controlling said predeterminate flow rate and establishing a pressure profile upstream of said delivery slice to ensure for an alignment of the fibers of the infed fiber stock suspension and the horizontal flow direction components of the flow direction of the infed fiber stock suspension substantially with said predetermined machine direction substantially simultaneously with a change in the adjustment of said adjusting means for adjusting said preselectable opening width of the delivery slice of said nozzle chamber;

said distribution box having a predetermined geometrical configuration across said predetermined web width;

said nozzle chamber having a predetermined geometrical configuration across said predetermined web width;

said control means containing means for selectively locally individually adjusting said predeterminate geometrical configuration of either said distribution box or said nozzle chamber; and said control means further including means for the selective infeed or outfeed of a fluid medium to at least one of said distribution box, said diffusor system and said nozzle chamber.

* * * * *